US006520074B1

(12) United States Patent
Sunata et al.

(10) Patent No.: US 6,520,074 B1
(45) Date of Patent: Feb. 18, 2003

(54) PRESSING MACHINE

(75) Inventors: Masahide Sunata, Komatsu (JP); Takao Sakaguchi, Komatsu (JP); Koji Murayama, Komatsu (JP)

(73) Assignees: Komatsu Ltd., Tokyo (JP); Komatsu Industries Corporation, Tokyo (JP)

( * ) Notice: Subject to any disclaimer, the term of this patent is extended or adjusted under 35 U.S.C. 154(b) by 206 days.

(21) Appl. No.: 09/635,536

(22) Filed: Aug. 9, 2000

(30) Foreign Application Priority Data

Aug. 18, 1999 (JP) ..... 11-231217

(51) Int. Cl.[7] ..... B30B 7/00; B30B 15/30; B30B 1/18; B30B 7/04

(52) U.S. Cl. ..... 100/137; 100/207; 100/231; 100/232

(58) Field of Search ..... 100/193, 207, 100/231, 232, 237, 214, 137; 72/472, 404, 455

(56) References Cited

U.S. PATENT DOCUMENTS 3,635,626 A * 1/1972 Pfeiffer ..... 100/257
3,779,155 A * 12/1973 Ohno ..... 100/207
5,363,686 A * 11/1994 Hite et al. ..... 470/166
5,586,495 A * 12/1996 Ogawa et al. ..... 100/207
5,916,345 A * 6/1999 Kobayashi ..... 100/272
5,957,046 A * 9/1999 Nakabayashi et al. ..... 100/231
5,970,763 A * 10/1999 Takayama ..... 72/1
6,000,322 A * 12/1999 To ..... 100/35
6,000,326 A * 12/1999 Nishida ..... 100/193

FOREIGN PATENT DOCUMENTS

JP 356014099 A * 2/1981

* cited by examiner

*Primary Examiner*—Allen Ostrager
*Assistant Examiner*—Jimmy Nguyen
(74) *Attorney, Agent, or Firm*—Armstrong, Westerman & Hattori, LLP

(57) ABSTRACT

An improved pressing machine for forming a work (21) being progressively or sequentially fed along a coil line, having a press assembly (1) that comprises a plurality of modular press units ($\mathbf{1_1}$, $\mathbf{1_2}$, $\mathbf{1_3}$, . . . ) connected from one to another in a direction in which the work (21) is progressively fed. Each of the press units ($\mathbf{1_1}$, $\mathbf{1_2}$, $\mathbf{1_3}$, . . . ) includes a C-form frame (2), a slide drive mechanism (6) disposed in an upper part of the C-form frame (2) and having in its drive source (7) a servo motor means operable under NC, and a slide (5) adapted to be driven by the slide drive mechanism to move in a given movement pattern. The press units ($\mathbf{1_1}$, $\mathbf{1_2}$, $\mathbf{1_3}$, . . . ) having their respective slides (5), at least some of which have at least one slide adapter plate (19) attached thereto, the at least one slide adapter plate extending across those at least some of the slides as a whole. With the pressing machine so constructed, mounting a die that is long in length to the slide adapter plate (19) enables forming a long or elongate work (21). Also, the pressing machine can be provided with a number of working stations in a direction of the coil line, thus enabling a multiple process step forming operation.

19 Claims, 15 Drawing Sheets

PRESSING MACHINE

BACKGROUND OF THE INVENTION

The present invention relates to a pressing machine that combines a plurality of modular press units together in each of which a C-form frame is adopted.

A pressing machine of the type described has been known that adopts a modular structure in which the press assembly is made up of a plurality of modular press units which are each built up and are interconnected to act as successive pressing stations of a given forming process.

Each of the press units so far employed in a pressing machine of modular structure comprises a bed, a plurality of uprights mounted to stand on the bed and a crown laid over the uprights. The press units thus taking each a portal structure have so far been used to build up primarily a progressive or a transfer press system.

The crown in each of the press units has installed therein a slide drive mechanism that may comprise a crank mechanism or a link mechanism, to which a slide is connected, e.g., at two or four points. Thus in each press unit, moving the slide vertically through the slide drive mechanism is designed to permit a work to be press formed between an upper die attached to the slide and a lower die mounted on a bolster.

In such conventional pressing machines of modular structure as described, inconveniences have been found to exist, however, e.g., because of a limitation in forming processes that can be adopted. Thus, since these press units are left independent of one another for different working stations with the slide and the bolster in one press unit being isolated from the slide and the bolster in another press unit, respectively, it has been impossible to attach and mount dies across these press units and then to adopt a forming process to form a work simultaneously in more than one press units.

Also, the use of a crank mechanism or a link mechanism for the slide drive mechanism does not allow the stroke distance of the slide to be altered as desired and hence has so far limited the machine's maximum possible output. Also, the press unit being of portal structure in which uprights are mounted on the bed to stand at its four corners has been found inconvenient, e.g., in that the uprights hinder installing a work conveyer means, or impede performing a setup operation in changing the dies to make it time-consuming and of poor workability.

Further, connecting the slide to the slide drive mechanism at two or four points has required that the slide and the bed be stiff and large enough to prevent them from deforming under a pressing load acting on them. Not only has this made the pressing machine costly, but the pressing machine inconveniently becomes high in its total height so as to require a pit deep or a building high enough to accommodate it. A further inconvenience is that if different pressing loads are acting on these point areas, shut heights may result varying from point to point, which impair parallelism between the lower surface of the slide and the upper surface of the bolster, hence the inability to form with due precision.

SUMMARY OF THE INVENTION

With the view to avoiding or alleviating these inconveniences met by the conventional pressing machine of modular type, it is an object of the present invention to provide a pressing machine of modular type that enables a forming process to be performed using a die that extends across press units. It is also an object of the present invention to provide a pressing machine of modular type that is high in productivity and forming precision and yet that can be made inexpensively.

These and other objects which will become more readily apparent hereinafter are attained in accordance with the present invention in a first form of implementation thereof by a pressing machine for forming a work being progressively fed along a coil line, having a press assembly that comprises a plurality of modular press units connected from one to another in a direction in which the work is progressively fed, each of the press units including a C-form frame, a slide drive mechanism disposed in an upper part of the C-form frame and having in its drive source a servo motor means operable under NC (numerical control), and a slide adapted to be driven by the slide drive mechanism to move in a given movement pattern, the press units having their respective slides as aforesaid, at least some of the slides having at least one slide adapter attached thereto, the at least one slide adapter extending across the at least some of the slides as a whole.

The construction described above permits a die or dies to be attached to the slide adapter over an entire length thereof and thus provides a pressing machine of modular type with a substantial expansion in the freedom to form, including an added ability to form an elongate work. Also, rendering the drive sources for the slide drive mechanisms in the press units operable each individually under NC allows the shut heights for all the slides to be maintained constant if different forming loads are acting on the slides. Thus, even then, the parallelism between the upper surfaces of the beds and the lower surface of the adapter plate can be held always constant, and the forming surfaces of all the dies can easily be adjusted in a given height, thereby permitting a work to be formed with due precision.

Also, using a servo motor operated under NC for the drive source for the slide drive mechanism allows the slide movement to be set in any given pattern as desired. Since this also allows the forming rate to be raised for a work that can be formed in a short slide stroke length, a substantial enhancement of productivity and a significant reduction of energy consumption are achieved for such works. It is also made possible for the slide or the slide adapter plate to be lowered fast immediately before the die carried by the slide adapter plate comes in contact with the work and then to be slowed down. Such a slide motion pattern has the effect of reducing the noises and vibrations which are emitted when the die is touching the work.

In addition, adopting a C-form frame in each of the modular press units gives rise to the advantage that the press unit and hence the pressing machine can be reduced in size, thus permitting the machine to be installed without the need for a deep pit or a high housing as hitherto required and hence quite with economy. Using C-form frames also allows resulting press units to be combined with an expanded freedom. It is thus made possible to make a choice easily between constructing a coil line with a minimum number of such press units and building a large-scale coil line in accordance with a particular kind of products to be formed.

Moreover, being devoid of the uprights in each of the press units renders it possible to accomplish easily and swiftly a setup operation as needed in exchanging dies, or as required to install or to adjust a work transfer means.

In order to achieve the objects mentioned above, the present invention also provides in a second form of implementation thereof a pressing machine for forming a work being progressively fed along a coil line, having a press assembly that comprises a plurality of modular press units connected from one to another in a direction in which the work is progressively fed, each of the press units including a C-form frame, a slide drive mechanism disposed in an upper part of the C-form frame and having in its drive source a servo motor means operable under NC, and a slide adapted to be driven by the slide drive mechanism to move in a given movement pattern, the press units having their respective beds, the beds having at least one bolster mounted thereon, the at least one bolster extending across a length of the press assembly.

The construction described above permits using a particular die individually for each of the press units. Thus, requiring only a die that is worn down to be exchanged, a pressing machine is provided that is economical to operate and maintain compared with conventional machines that necessitate exchanging all the dies as a whole.

Also, using a servo motor operated under NC for the drive source for the slide drive mechanism allows the slide movement to be set in any given pattern as desired. Since this also allows the forming rate to be raised for a work that can be formed in a short slide stroke length, a substantial enhancement of productivity and a significant reduction of energy consumption are achieved for such works. It is also made possible for the slide or the slide adapter plate to be lowered fast immediately before the die carried by the slide adapter plate comes in contact with the work and then to be slowed down. Such a slide motion pattern has the effect of reducing the noises and vibrations which are emitted when the die is touching the work.

In addition, adopting a C-form frame in each of the modular press units gives rise to the advantage that the press unit and hence the pressing machine can be reduced in size, thus permitting the machine to be installed without the need for a deep pit or a high housing as hitherto required and hence quite with economy. Using C-form frames also allows resulting press units to be combined with an expanded freedom. It is thus made possible to make a choice easily between constructing a coil line with a minimum number of such press units and building a large-scale coil line in accordance with a particular kind of products to be formed.

Moreover, being devoid of the uprights in each of the press units renders it possible to accomplish easily and swiftly a setup operation as needed in exchanging dies, or as required to install or to adjust a work transfer means.

In either of the constructions provided by the first and second forms of implementation of the present invention described above, the press units may be connected from one to another by fastening the respective C-form frames of the adjacent press units together by fastening means for the press units as a whole.

The specific construction described above increases stiffness properties of the C-form frames and thereby reduces their tendency to open under a forming load. Achieving a due forming precision is therefore ensured.

In any of the generic and specific constructions described above, the pressing machine preferably has a first and a second press assembly each of which is constructed as defined therein, the first and second press assemblies being arranged with their fronts opposed to each other across a coil line, the front of the first press assembly being defined by the respective front faces of the press units of the first press assembly and the front of the second press assembly being defined by the respective front faces of the press units of the second press assembly, each pair of the respective press units of the first and second press assemblies opposed to each other being interconnected by fastening their respective beds and crowns by fastening means for the press units as a whole.

This specific construction almost eliminates a shortcoming of presses that adopt C-form frames, i.e., the C-form frame tending to open under a forming load, and thus serves to markedly enhance forming precision attainable. That specific construction which also doubles the transverse width of the press body makes the resulting pressing machine available to meet with a requirement to form a wider work.

In any of the specific and generic constructions mentioned before, the machine preferably has a first and a second press assembly each of which is constructed as defined therein, the first and second press assemblies being arranged with their fronts opposed zigzag to each other across a coil line, the front of the first press assembly being defined by the respective front faces of the press units of the first press assembly and the front of the second press assembly being defined by the respective front faces of the press units of second press assembly, each pair of the respective press units of the first and second press assemblies opposed zigzag to each other being interconnected by fastening their respective beds and crowns by fastening means for the press units as a whole.

This specific construction provides the pressing machine with an expanded capability of forming and a variation of forming pattern, including an added ability to form works of different shapes or configurations on a pair of working lines across the coil line, established in the machine and an ability to form works by removing stock across a pair of press units opposed obliquely to each other. That specific construction enables works of different types to be formed at the same time. Thus, by increasing the yield of material that can be formed, it serves to reduce the unit prices of formed products.

In any of the constructions of the invention so far described, the pressing machine preferably further comprises spacer means adapted to be interposed between the respective C-form frames of the adjacent press units as a whole to permit an entire length of the press assembly to be established as desired.

This specific construction permits increasing the entire length of the press body and thus allows a work longer in length to be formed. It also permits providing an idling station between the working stations and makes it possible to perform a multiple step operation, e.g., a six-step forming operation with four press units.

Alternatively or in addition in any of the generic or specific constructions mentioned above, the pressing machine preferably further comprises spacer means adapted to be interposed between the respective beds and between the respective crowns of the press units opposed to each other as a whole to permit a width of the first and second press assemblies in their transverse direction.

This specific construction that permits increasing the width of the press body in its transverse direction allows a work wider to be formed. That specific construction also permits works to be formed on two rows of working line established as coil lines in the pressing machine, and thus allows achieving an increased productivity.

In this connection, it is desirable that the spacer means be made adjustable in width.

This specific construction permits altering the pitch between adjacent working stations and/or the pitch between a working station and an idling station as desired.

In any of the constructions mentioned above, the press assembly preferably includes press units for draw forming, and an adapter plate attached to the slides of the press units for draw forming is made independent of an adapter plate attached to the slides of the press units not for draw forming.

This specific construction prevents a forming load in a draw forming operation from effecting on any other forming operation, and thus ensures achieving a due precision the process incorporates a draw forming step.

These and other features, objects and advantages of the invention will be more readily understood or apparent to those skilled in the art from a reading of the following detailed description of preferred forms of embodiment of the present invention as illustrated in the various drawing figures.

DESCRIPTION OF THE PREFERRED EMBODIMENT

Figure 1:
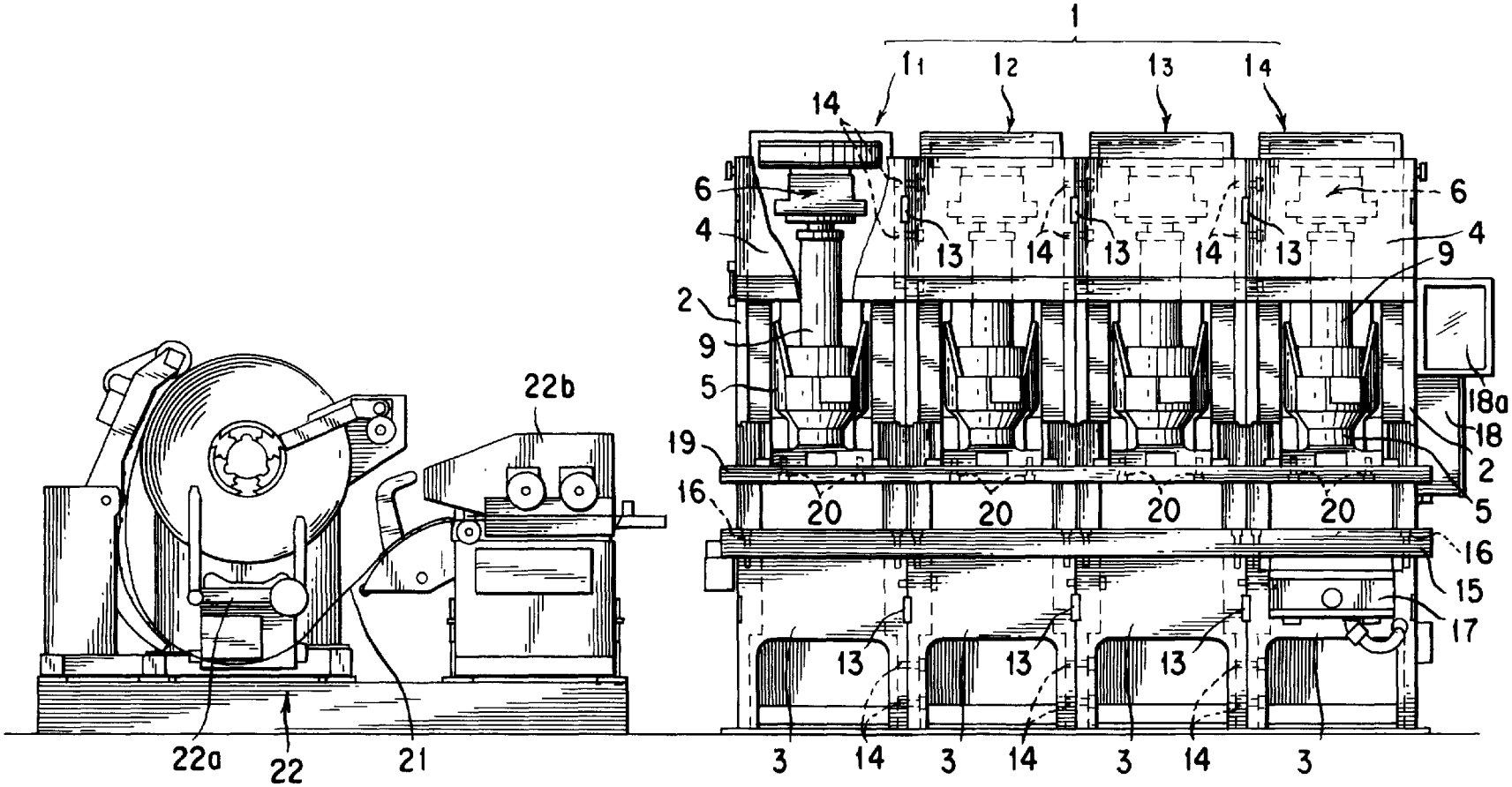
FIG. 1 is a front view that illustrates a press machine according to a first form of embodiment of the present invention.
Figure 2:
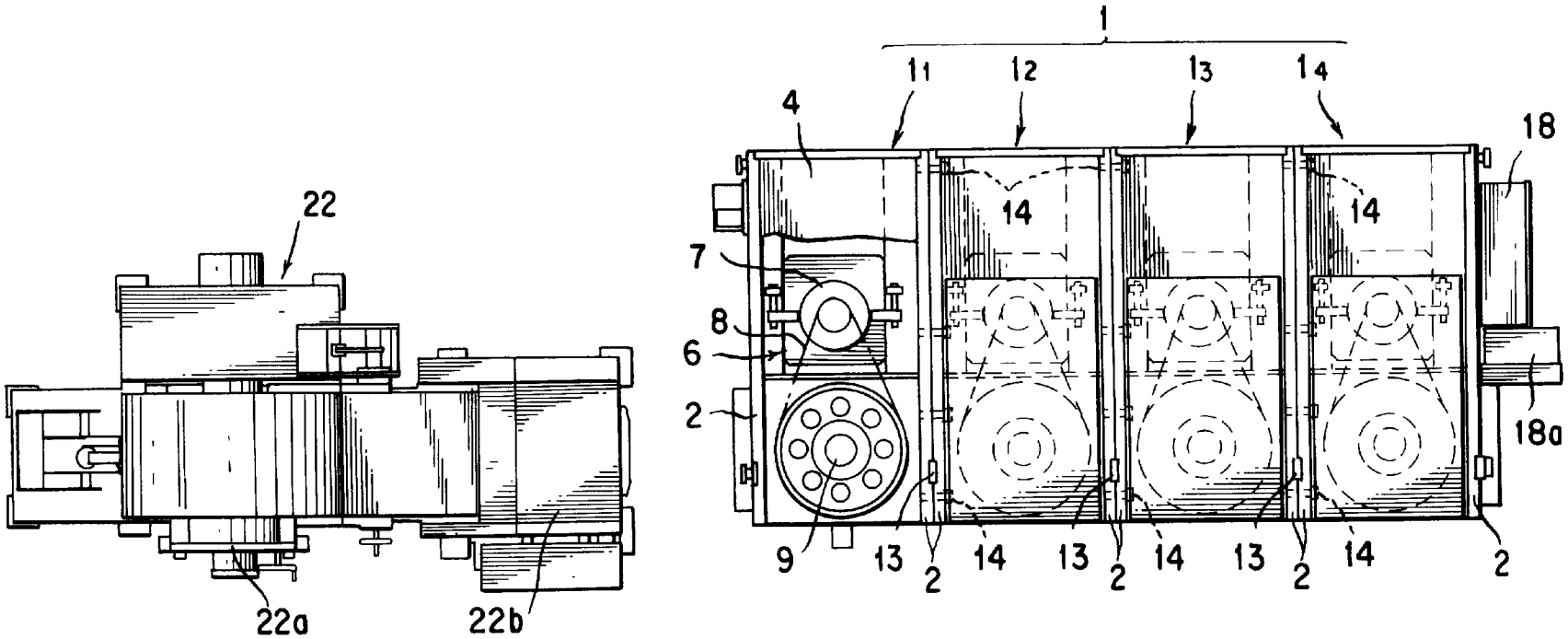
FIG. 2 is a top plan view of the press machine according to the first form of embodiment of the present invention.
Figure 3:
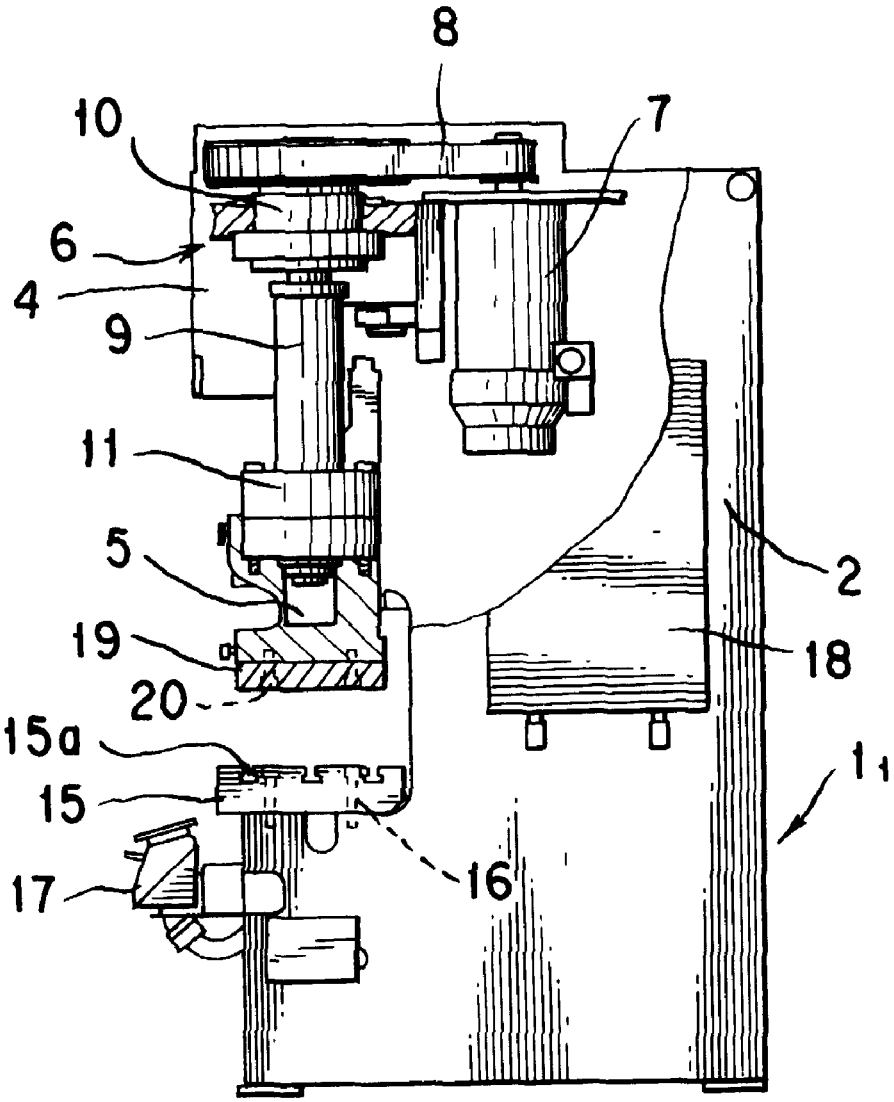
FIG. 3 is a side view of the press machine according to the first form of embodiment of the present invention in part fragmented and as seen from the right hand side in FIG. 1.

Referring first to FIGS. 1 to 3, there is shown a pressing machine that represents a first form of embodiment of the present invention in which a work forming press assembly 1 (hereinafter simply referred to as "press") comprises a plurality of, say four (4) as shown, modular press units $\mathbf{1}_1$, $\mathbf{1}_2$, $\mathbf{1}_3$, $\mathbf{1}_4$ which are connected from one to another to constitute a progressive press line (hereinafter referred to as "coil line").

Each of the press units $\mathbf{1}_1$, $\mathbf{1}_2$, $\mathbf{1}_3$, $\mathbf{1}_4$ includes a pair of C-form frames 2 mounted at its opposite sides, a bed 3 that connects lower ends portion of the C-form frames 2, and a crown 4 that connects upper portions of the C-form frames. (Hereinafter, for the sake of convenience, the term "bed" is used to designate a lower portion, and the term "crown" is used to designate an upper portion, of the C-form frame 2). Each press unit $\mathbf{1}_1$, $\mathbf{1}_2$, $\mathbf{1}_3$, $\mathbf{1}_4$ also includes a slide 5 disposed below the crown 4 so as to be movable vertically up and down, and a slide drive mechanism 6 disposed in the crown 4 for raising and lowering the slide 5.

The slide drive mechanisms 6 are here designed to be operable independently of each other individually for respective processing stations constituted by those press units $\mathbf{1}_1$, $\mathbf{1}_2$, $\mathbf{1}_3$, $\mathbf{1}_4$. Each slide drive mechanism 6 includes as its drive source 7 a servo motor that is operated under NC (numerical control) from a control panel 18 to be described later to provide a given movement pattern for the slide 5. Power from the drive source 7 is transmitted via a power transmission means 8 such as a timing belt to a slide drive shaft 9 which may comprise a ball screw or lead screw.

The slide drive shaft 9 as seen to extend vertically above the slide 5 has an upper end side rotatably supported by a bearing 10 in the crown 4 and a lower end side threaded in mesh with a ball nut 11 so that a controlled rotation of the slide drive shaft 9 by the drive source 7 may cause the slide 5 to move in a given controlled movement or motion (free motion) pattern vertically up and down.

In assembling the press units $\mathbf{1}_1$, $\mathbf{1}_2$, $\mathbf{1}_3$, $\mathbf{1}_4$ so constructed as described above, the beds 3 in the adjacent press units are made in alignment precisely with each other by means of keys 13 and so are the crowns 4 by keys 13. Then, so that the press units $\mathbf{1}_1$, $\mathbf{1}_2$, $\mathbf{1}_3$, $\mathbf{1}_4$ may lie in alignment with each other from the upstream to the downstream side of the coil line, the adjacent beds 3 are interconnected by means of fastening means 14 such as bolts and so are the adjacent crowns 4 to make up the press 1. Further, an elongate bolster 15 as shown is fastened by means of fastening means 16 such as bolts to the beds 3 of the press units $\mathbf{1}_1$, $\mathbf{1}_2$, $\mathbf{1}_3$, $\mathbf{1}_4$ so as to extend over them all horizontally in a direction of the coil line.

In interconnecting and thus assembling together the press units $\mathbf{1}_1$, $\mathbf{1}_2$, . . . , it should be noted that alternatively the adjacent C-form frames 2 may be made in alignment with each other by keys 13 and then fastened together by fastening means 14 such as bolts.

As shown in FIG. 3, the bolster 15 is formed in an upper surface thereof longitudinally with a plurality of T-slots 15*a* for use in securing mounting dies (not shown) onto the bolster 15. The bolster 15 has rollers and positioning pins capable of rising and setting from upper surface of the bolster by lifters, respectively and provided with an auto lower die damper disposed in place. The slide adapter plate 19 is provided with an auto upper die damper disposed in place. Firstly, the lower die superimposed by the upper die is brought to the prescribed position on the bolster 15 which rising the rollers and the corresponding pins from the surface thereof. After positioning the lower die at the prescribed position, the lower die is mounted on the upper surface of the bolster by setting the rollers and fixed thereon by the auto lower die clamper. Next, the slide adapter plate is descended with the slide 5 and when under surface of the slide adapter plate 19 contacts the upper surface of the lower die, the upper die is fixed to the slide adapter plate by the auto upper die clamper. Removal of both the dies can be carried out by reverse way. Further, as shown in FIGS. 1 and 2, the machine has an operating panel 17 for use in operating the press 1 and a control panel 18 provided with a display means 18*a*. The operating panel 17 and the control panel may for example be attached to the front face of the bed 3 and that of the C-form frame 2, respectively, of the press unit in the most downstream side, $\mathbf{1}_4$, as shown. This operating panel 17 is a portable-type one which has manual operation buttons to operate press machines and a connector to be connected with each of connectors of the press machines. The operating panel 17 is used for die matching, checking forming conditions of works. Thus all the press machines which each has such connector can be selectively operated by this operating panel 17.

Shown also included in the press 1 is a slide adapter plate 19 which is fastened by means of fastening means 20 such as bolts to the lower surfaces of the slides 5 of the press units $\mathbf{1}_1$, $\mathbf{1}_2$, . . . , the slide adapter plate 19 here extending over all those slides 5 in a direction of the coil line.

In the upstream of the coil line, there is included a work supply means 22 for supplying a work 21 onto the coil line. The work supply means 22 comprises an uncoiler 22*a* for delivering the work 21 in the form of an uncoiled metal sheet or plate, and a work feed means 22*b* for progressively feeding or advancing the delivered work 21 along the coil line. The work supply means 22 is designed as a whole to supply a work 21 into the press 1 in synchronism with an operation of the press 1.

An explanation is next given in respect of a method of forming a work 21 by using the press 1 so constructed as described above.

In forming the work 21, dies are attached to the upper surface of the bolster 15 and to the lower surface of the slide adapter plate 19. In this case, using such dies as for forming a work progressively or sequentially in a plurality of process steps and setting up respective process stations in the four press units $\mathbf{1}_1$, $\mathbf{1}_2$, $\mathbf{1}_3$ and $\mathbf{1}_4$ allow the work 21 to be formed progressively or sequentially in four process steps. Also, owing to the fact that the bolster 15 and the slide adapter plate 19 are each made of a single plate and that the slide adapter plate 19 is vertically moved up and down by driving the slides 5 simultaneously, it is also possible for forming to selectively use one die of those dies for use in one, two, three and four process steps, respectively.

Also, the fact that the press units $\mathbf{1}_1$, $\mathbf{1}_2$, $\mathbf{1}_3$, $\mathbf{1}_4$ are devoid of the so far disturbing uprights as in the conventional portal type press of modular structure but have the C-form frames 2 each providing an opening in its front allows a set-up operation as need in exchanging dies or required to install and/or adjusts a work transfer means (not shown) to be accomplished swiftly and easily. The work transfer means comprises a pair of spaced-apart bars which are arranged along the work transferring direction and which have a plurality of fingers attached them for gripping works. The pair of bars are supported at their appropriate upstream and downstream portions and reciprocated in the tree-dimensional directions by driving servomotors. Thus, the work transfer means transfers the works in order by its appropriate feed motion.

After the press 1 is loaded with the dies or die, the work supply means 22 disposed upstream of the coil line is operated to supply a work 21 and to start feeding it progressively or sequentially. The ability for the drive sources 7 comprising servo motors installed in the press units $\mathbf{1}_1$, $\mathbf{1}_2$, . . . to be operated under NC independently of each other by the control panel 18 allows the parallelism between the upper surface of the bolster 15 and the lower surface of the slide adapter plate 19 to be maintained substantially constant against a possible offset or imbalance in the load acting on the slide adapter plate 19 while the work is being formed. This can be achieved by controlling the drive sources 7 each individually so that the slide shut heights of all the press units $\mathbf{1}_1$, $\mathbf{1}_2$, . . . may become constant. Forming with due accuracy is thereby ensured.

Also, the use as the drive source 7 of a servo motor that enables the slide to be moved at any stroke speed as desired permits the slide to be moved down first rapidly from its upper dead point and then to be slowed down immediately before the upper die is coming into contact with the work 21. This serves to reduce a noise and vibrations which are emitted when the die is striking on the work 21. Further, the ability of the drive source 7 comprised of a servo motor to variably adjust the stroke distance of the slide allows using a short slide stroke distance for a work that can be formed requiring no long stroke distance. A reduction in forming time is thereby achieved; hence an increase in productivity.

Figure 4:
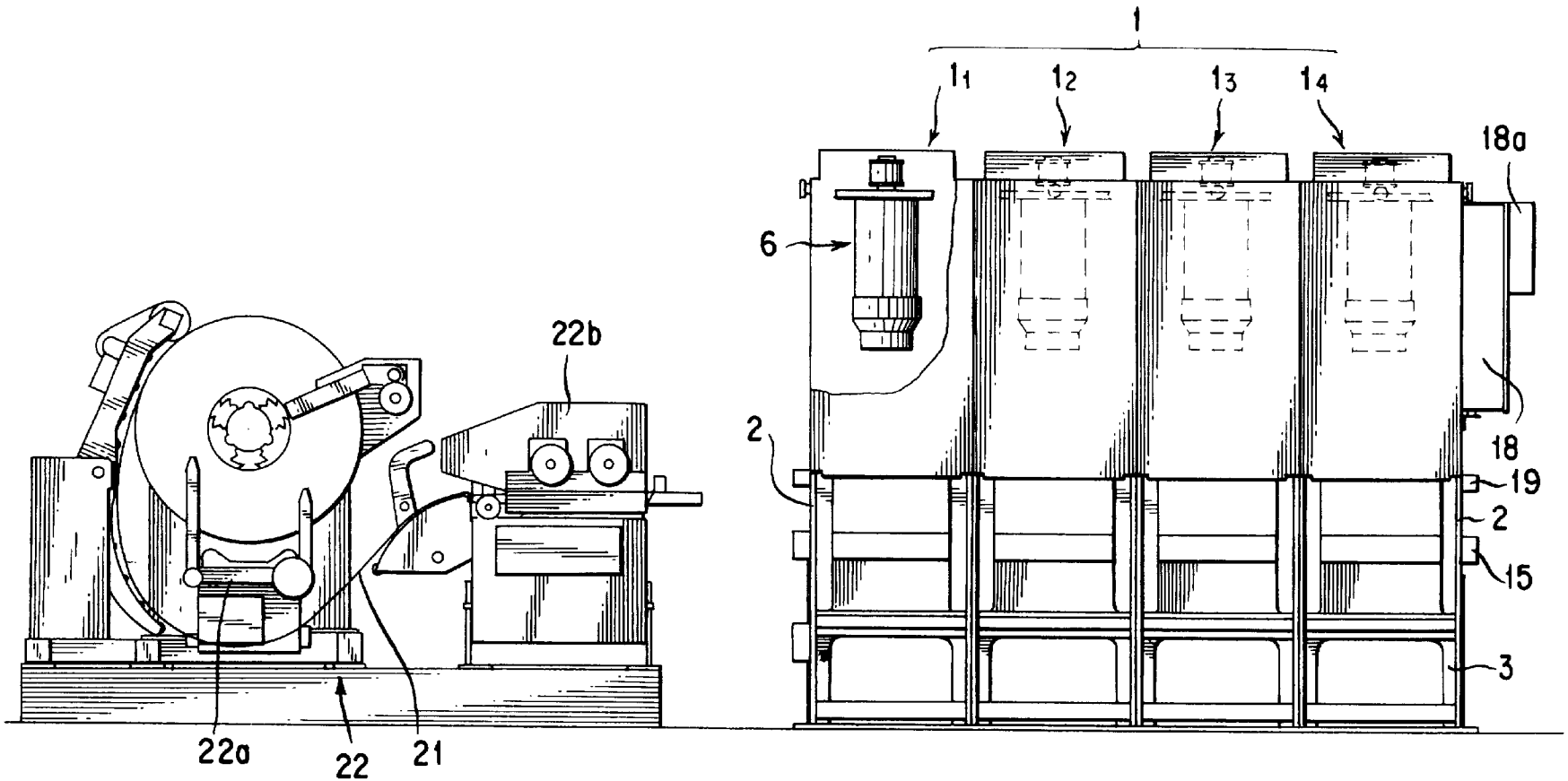
FIG. 4 is a front view that illustrates a press machine according to a second form of embodiment of the present invention.
Figure 5:
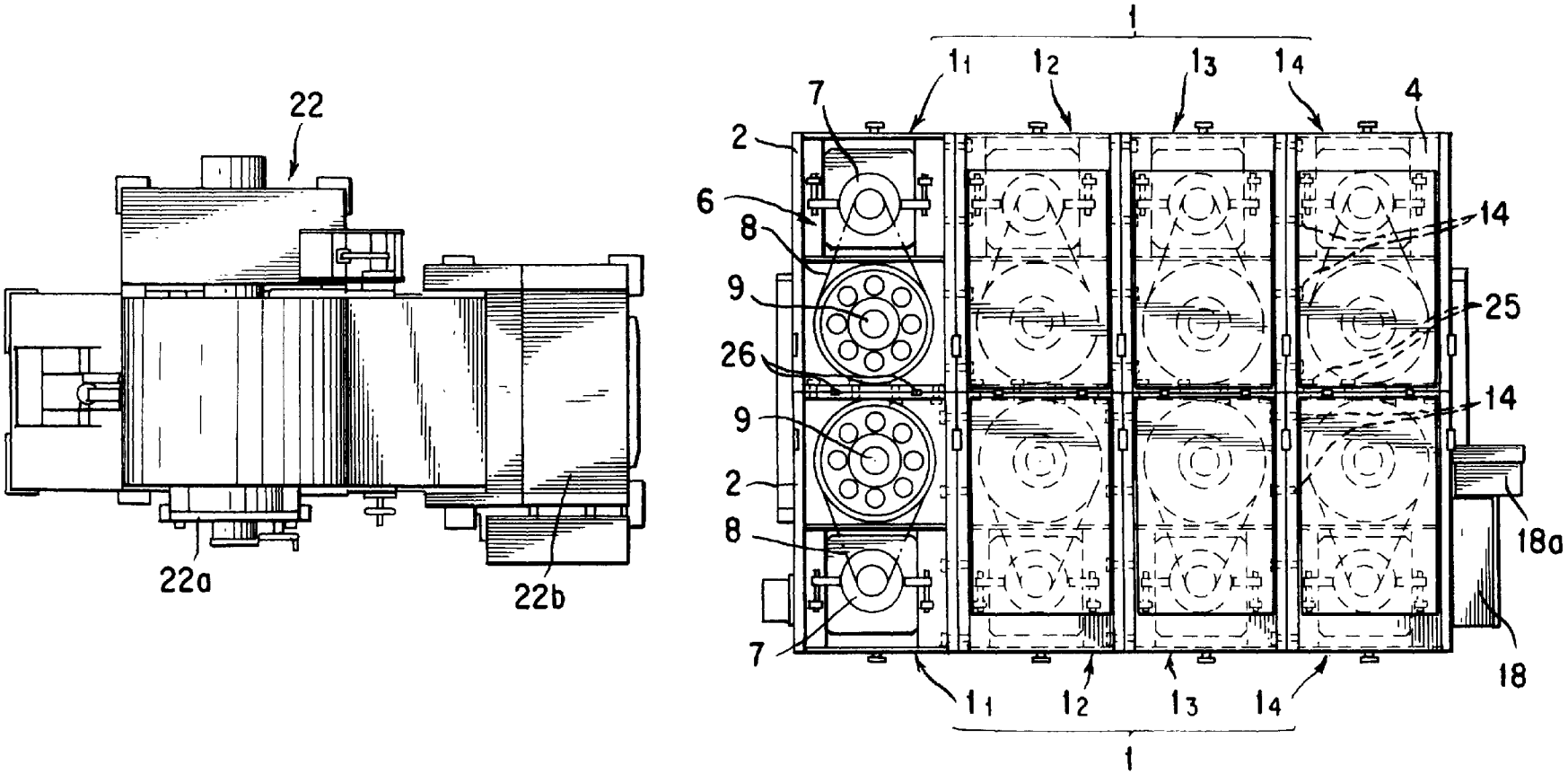
FIG. 5 is a top plan view of the press machine according to the second form of embodiment of the present invention.
Figure 6:
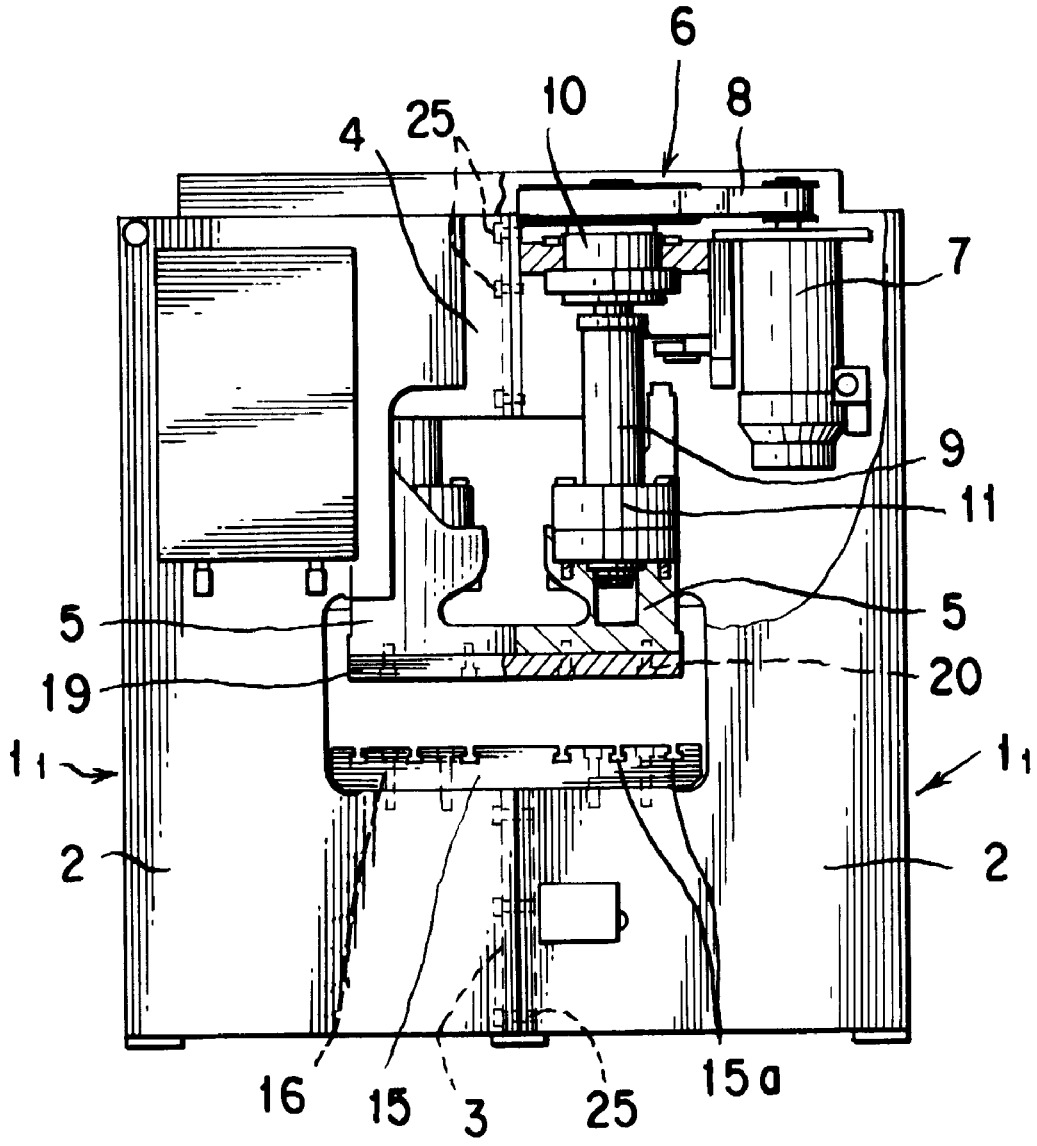
FIG. 6 is a side view of the press machine according to the second form of embodiment of the present invention in part fragmented and as seen from the right hand side in FIG. 4.

While in the first form of embodiment thus far described, four press units $\mathbf{1}_1$, $\mathbf{1}_2$, $\mathbf{1}_3$, $\mathbf{1}_4$ are interconnected in a straight line along the coil line to make up a single press 1, in the second form of embodiment of the invention as depicted in FIGS. 4 to 6 a pair of presses, a first press 1 and a second press 1, each of which comprises the press 1 of the first form of embodiment, are prepared and arranged so that the press units of the first press 1 and the press units $\mathbf{1}_1$, $\mathbf{1}_2$, $\mathbf{1}_3$, $\mathbf{1}_4$ of the second press 1 are opposed to each other, respectively, across the coil line. As illustrated the press units $\mathbf{1}_1$, $\mathbf{1}_2$, $\mathbf{1}_3$, $\mathbf{1}_4$ for use in the second form of embodiment are basically identical to those in the first form of embodiment and hence by simply using the same reference characters to designate the same parts or components their repeated explanation is omitted. This will apply also in explanations of the third form of embodiment to be described later and a modification thereof.

Each pair of the press units $\mathbf{1}_1$ and $\mathbf{1}_1$, $\mathbf{1}_2$ and $\mathbf{1}_2$, $\mathbf{1}_3$ and $\mathbf{1}_3$, and $\mathbf{1}_4$ and $\mathbf{1}_4$ opposed to each other across the coil line are shown connected to each other by connecting together their respective beds 3 and 3, and also their respective crowns 4 and 4. The respective beds 3 and 3 and also the respective crowns 4 and 4 may be connected together by aligning them with each other using keys 26 and then fastening them together using a fastening means such as bolts 25.

Also, a bolster 15 made of a single plate is fastened onto the beds 3 of all the press units $\mathbf{1}_1$, $\mathbf{1}_1$, $\mathbf{1}_2$, . . . , $\mathbf{1}_4$, $\mathbf{1}_4$ so as to extend over them, using the fastening means 16, and a slide adapter plate 19 made of a single plate is fastened to the lower surfaces of the slides 5 of all the press units $\mathbf{1}_1$, $\mathbf{1}_1$, $\mathbf{1}_2$, . . . , $\mathbf{1}_4$, $\mathbf{1}_4$ so as to extend over them, using the fastening means 20. This will complete the entire makeup of the pressing machine.

Next, in the explanation of an operation, effects and advantages of the pressing machine so constructed as described above, the machine is loaded with a die or dies for forming by attaching the same to both the bolster 15 and the slide adapter plate 19 both of which extend over the eight (8) press units $\mathbf{1}_1$, $\mathbf{1}_1$, $\mathbf{1}_2$, . . . , $\mathbf{1}_4$, $\mathbf{1}_4$. Thus, since both the bolster 15 and the slide adapter plate 19 here have each a width twice as large as that in the first form of embodiment, the machine permits attaching a larger die or dies and has the capability of forming a work 21 that is larger as well.

Operating the respective drive sources 7 of the press units $\mathbf{1}_1$, $\mathbf{1}_1$, $\mathbf{1}_2$, . . . , $\mathbf{1}_4$, $\mathbf{1}_4$ each individually under NC allows, against any possible offset or unbalance in the work forming load, the shut heights of all those press units $\mathbf{1}_1$, $\mathbf{1}_1$, $\mathbf{1}_2$, . . . , $\mathbf{1}_4$, $\mathbf{1}_4$ to be made equal to each other and thus the parallelism between the upper surface of the bolster 15 and the lower surface of the slide adapter plate 19 to be maintained substantially constant. Forming with high precision is thereby made possible. Also, connecting for each pair of press units $\mathbf{1}_1$ and $\mathbf{1}_1$, $\mathbf{1}_2$ and $\mathbf{1}_2$, $\mathbf{1}_3$ and $\mathbf{1}_3$, and $\mathbf{1}_4$ and $\mathbf{1}_4$ their respective beds 3 and 3 together and their respective crowns 4 and 4 together prevents the C-form frame 2 if adopted into each of all those press units from opening under the forming load and enhances the forming precision to an extent even more than that attainable in the first form of embodiment.

Figure 7:
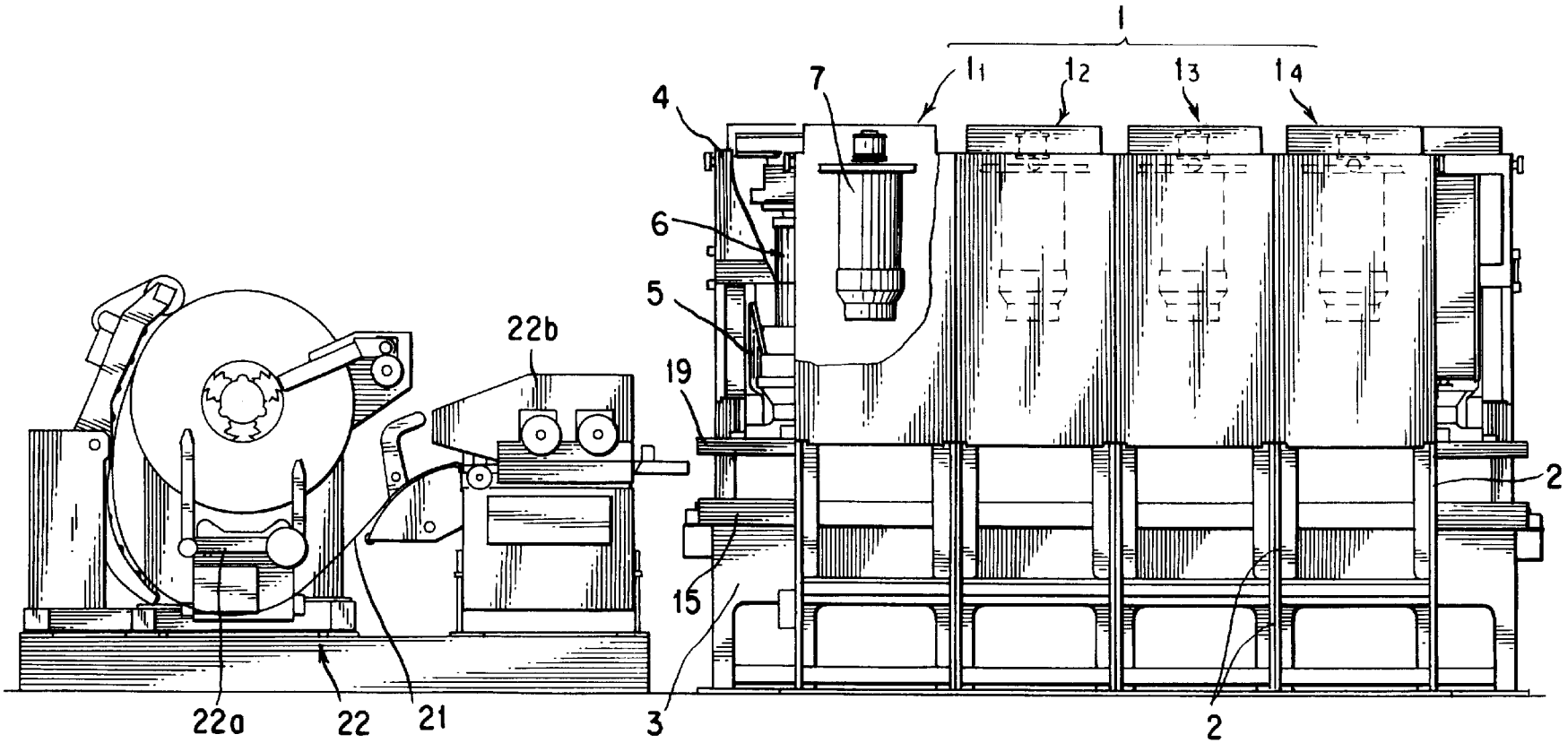
FIG. 7 is a front view that illustrates a press machine according to a third form of embodiment of the present invention.
Figure 8:
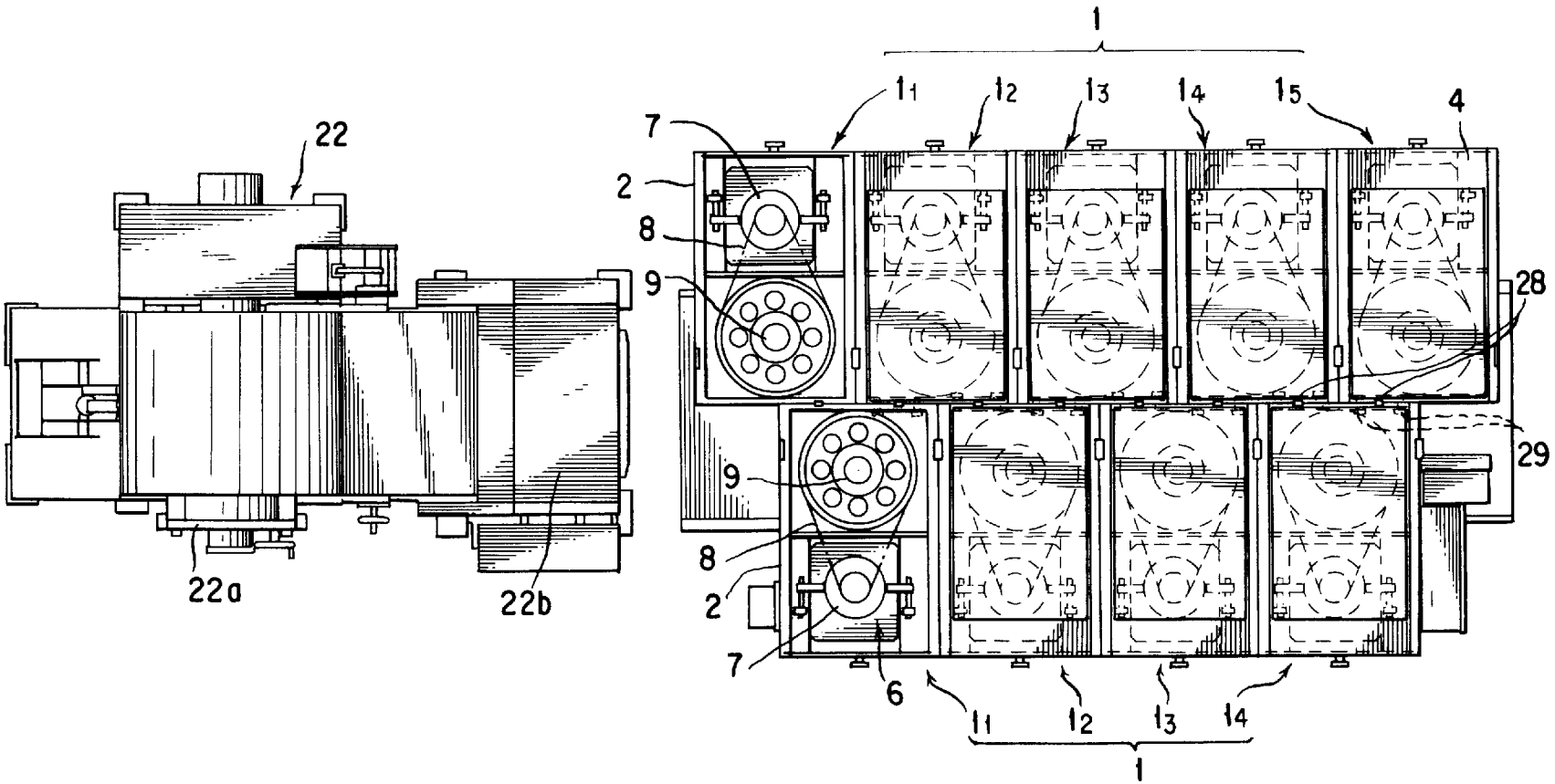
FIG. 8 is a top plan view of the press machine according to the third form of embodiment of the present invention.
Figure 9:
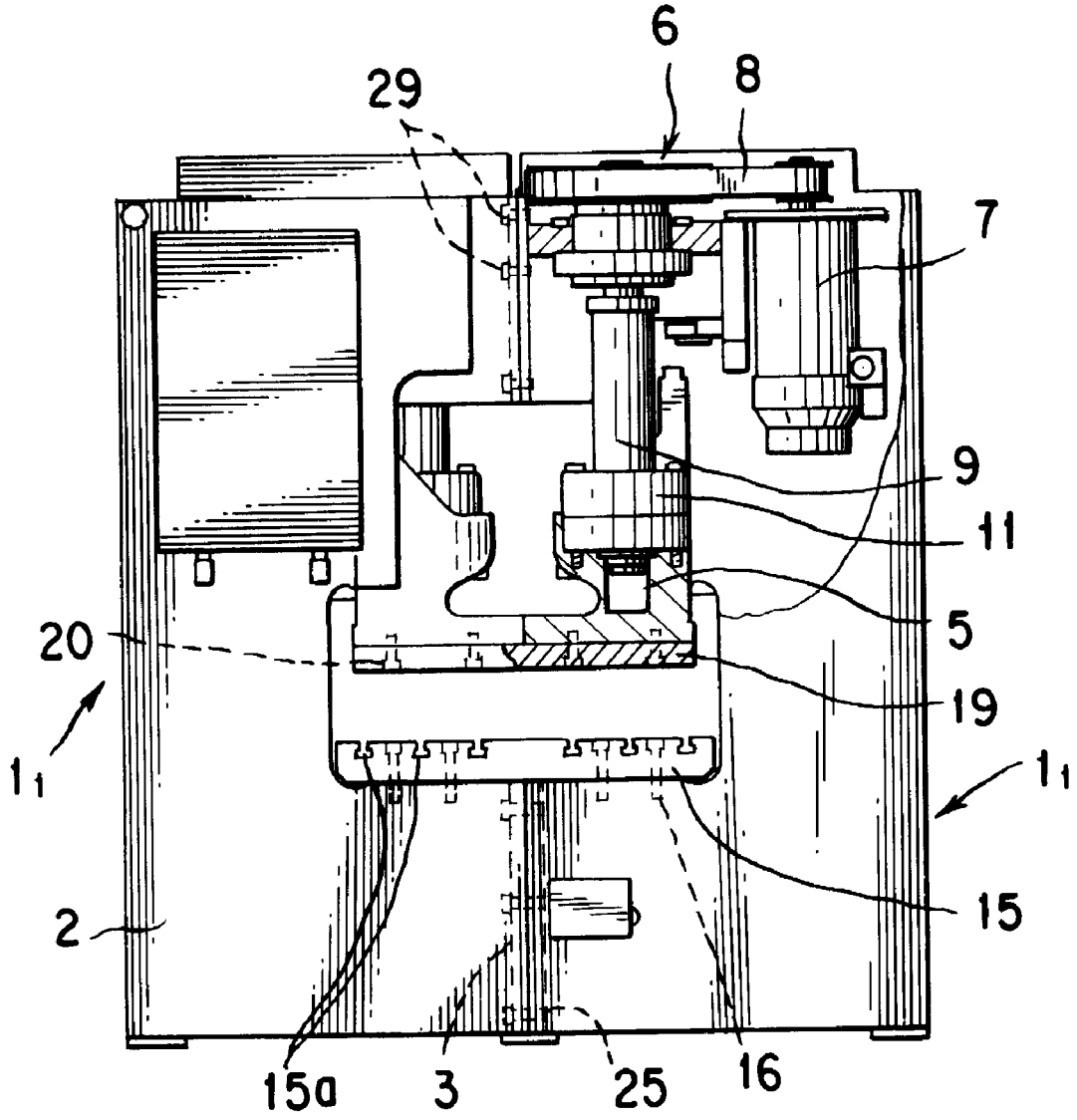
FIG. 9 is a side view of the press machine according to the third form of embodiment of the present invention in part fragmented and as seen from the right hand side in FIG. 7.

FIGS. 7 to 9 illustrate a pressing machine according to a third form of embodiment of the present invention, of which an explanation is now given.

In the third form of embodiment, a first and a second presses 1 and 1 are employed as in the second form of embodiment. In this embodiment, however, the first set of press unit 1 is made up of, e.g., five press units $\mathbf{1}_1$, $\mathbf{1}_2$, . . . , $\mathbf{1}_5$ interconnected along the coil line, and the second set of press units is made up of, e.g., four press units $\mathbf{1}_1$, $\mathbf{1}_2$, . . . , $\mathbf{1}_4$ interconnected along the coil line, and they are so arranged that the press units $\mathbf{1}_1$, $\mathbf{1}_2$, . . . , $\mathbf{1}_5$ of the first set 1 and the press units $\mathbf{1}_1$, $\mathbf{1}_2$, . . . , $\mathbf{1}_4$ of the second set 2 are opposed zigzag to one another. The opposed beds 3 and the opposed crowns 4 of all the press units $\mathbf{1}_1$, $\mathbf{1}_2$, . . . , $\mathbf{1}_5$ and $\mathbf{1}_1$, $\mathbf{1}_2$, . . . , $\mathbf{1}_4$ in position using keys 28 are fastened together, respectively, using fastening means 29 such as bolts.

Next, an explanation is given in respect of an operation, effects and advantages of the pressing machine according to the third form of embodiment of the invention. Arranging the two presses 1 and 1 across the coil line to have their fronts opposed to each other with the press units disposed to take zigzag positions $\mathbf{1}_1$, $\mathbf{1}_1$, $\mathbf{1}_2$, $\mathbf{1}_2$, $\mathbf{1}_3$, $\mathbf{1}_3$, $\mathbf{1}_4$, $\mathbf{1}_4$, $\mathbf{1}_5$ allows establishing working lines in two rows in front and in rear on the coil line to permit two works to undergo a forming operation to yield identical products, forming operation to yield products different in configuration or forming operations different in the step number, in front and in rear.

Also, using press units positioned oblique in front and in rear makes it possible, e.g., to form a product with stock removed oblique and, expanding the range of choices for stock removal, achieves an increase in the yield by stock material.

Figure 10:
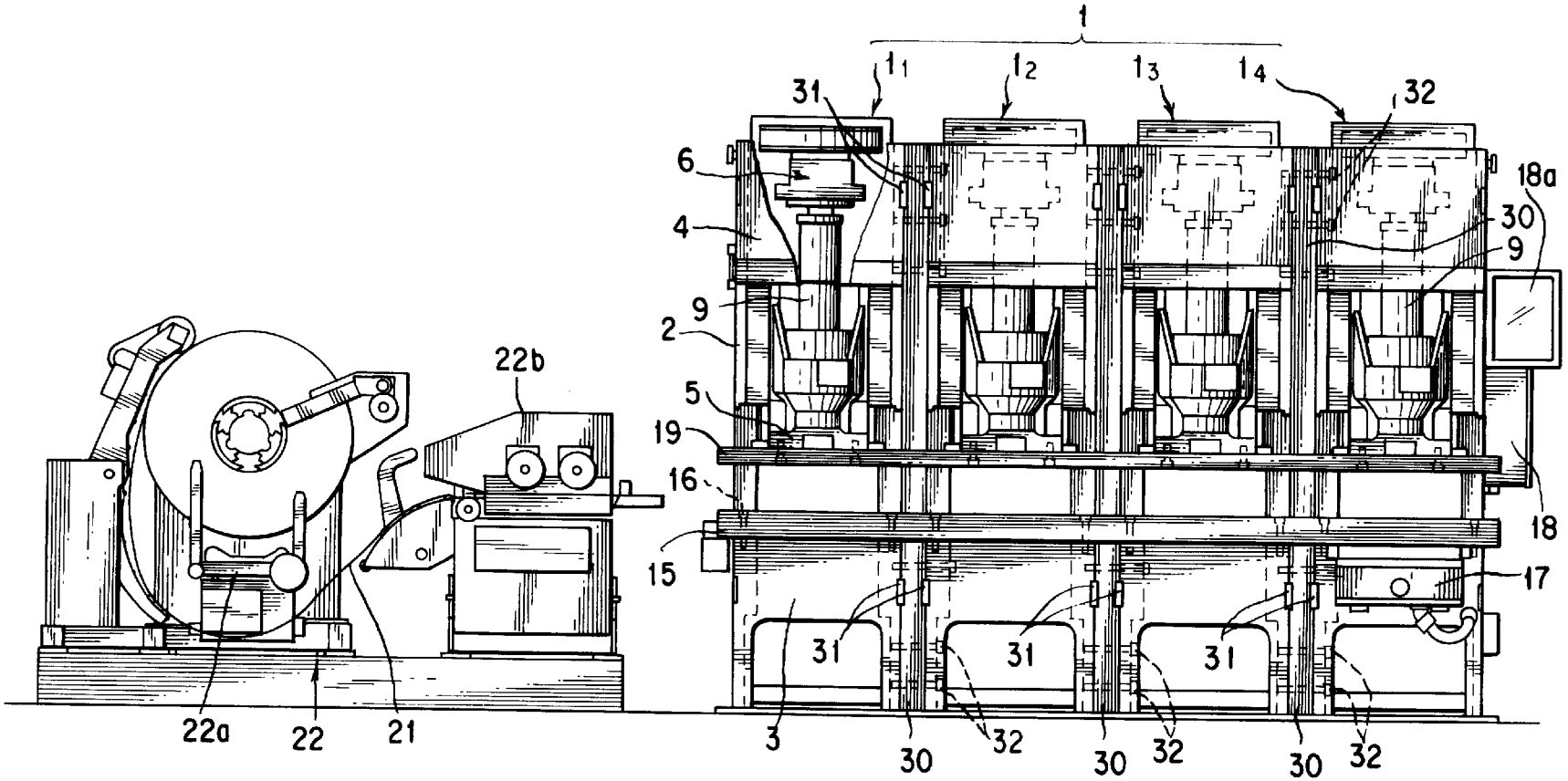
FIG. 10 is a front view that illustrates a modification of the machine according to the first form of embodiment of the present invention.
Figure 11:
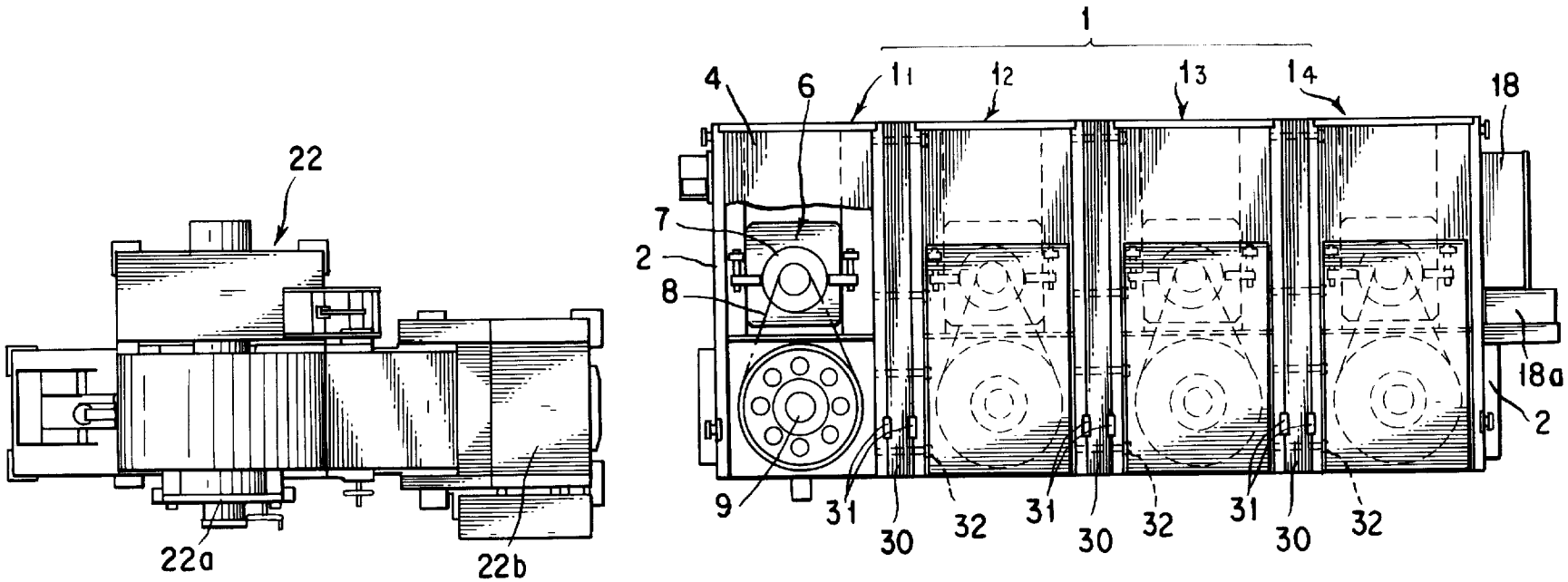
FIG. 11 is a top plan view of that modification of the press machine according to the first form of embodiment of the present invention.
Figure 12:
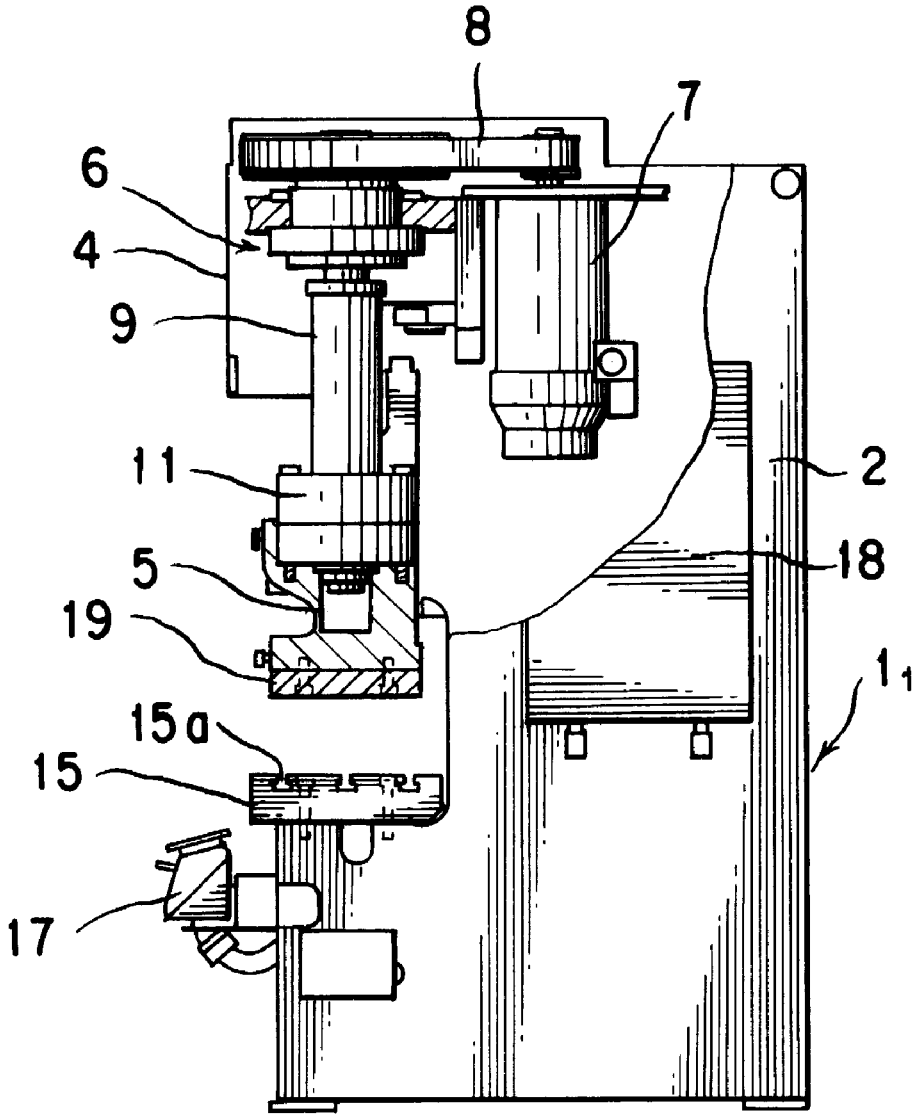
FIG. 12 is a side view of that modification of the press machine according to the first form of embodiment of the present invention in part fragmented and as seen from the right hand side in FIG. 10.

FIGS. 10 to 12 illustrate a pressing machine according to a modification of the first form of embodiment of the present invention shown in and previously described in connection with FIGS. 1 to 3, of which an explanation is now given.

While in the first form of embodiment a plurality of press units $\mathbf{1}_1$, $\mathbf{1}_2$, . . . are interconnected in a direction of the coil line to constitute a press set 1, in this modified form of embodiment provision is further made to have spacers 30 interposed between adjacent press units $\mathbf{1}_1$ and $\mathbf{1}_2$, . . . in order to increase the length of the press 1, thereby making it possible to meet with a requirement for forming a work that is longer than usual.

To this end, spacers 30 positioned using keys 31 are interposed between the mutually adjacent beds 3 and 3 of all the press units $\mathbf{1}_1$, $\mathbf{1}_2$, . . . and those beds 3 and 3 are fastened together and interconnected using fastening means 32 such as bolts inserted so as to penetrate the spacers 30.

Similar spacers 30 positioned with keys 31 are also interposed between the mutually adjacent crowns 4 and 4 of all the press units $\mathbf{1}_1$, $\mathbf{1}_2$, . . . and those crowns 4 and 4 are interconnected and fastened together using fastening means 32 such as bolts inserted so as to penetrate the spacers 30.

The pressing machine so constructed as described according to the modified first form of embodiment is operable as well to form a work 21 being progressively or sequentially along the coil line as in the pressing machine according to the unmodified first form of embodiment. With the press body 1 increased in the total longitudinal length by a sum of the width of the spacers 30 interposed between the adjacent press units $\mathbf{1}_1$, $\mathbf{1}_2$, . . . in the direction of the coil line, the modified pressing machine has an added capability of forming an exceptionally long or elongate work 21. Also, the spacers 30 may serve to provide an additional working station between adjacent press units. It is thus also made possible to include, e.g., one or more draw forming stages between usual working stations.

Figure 13:
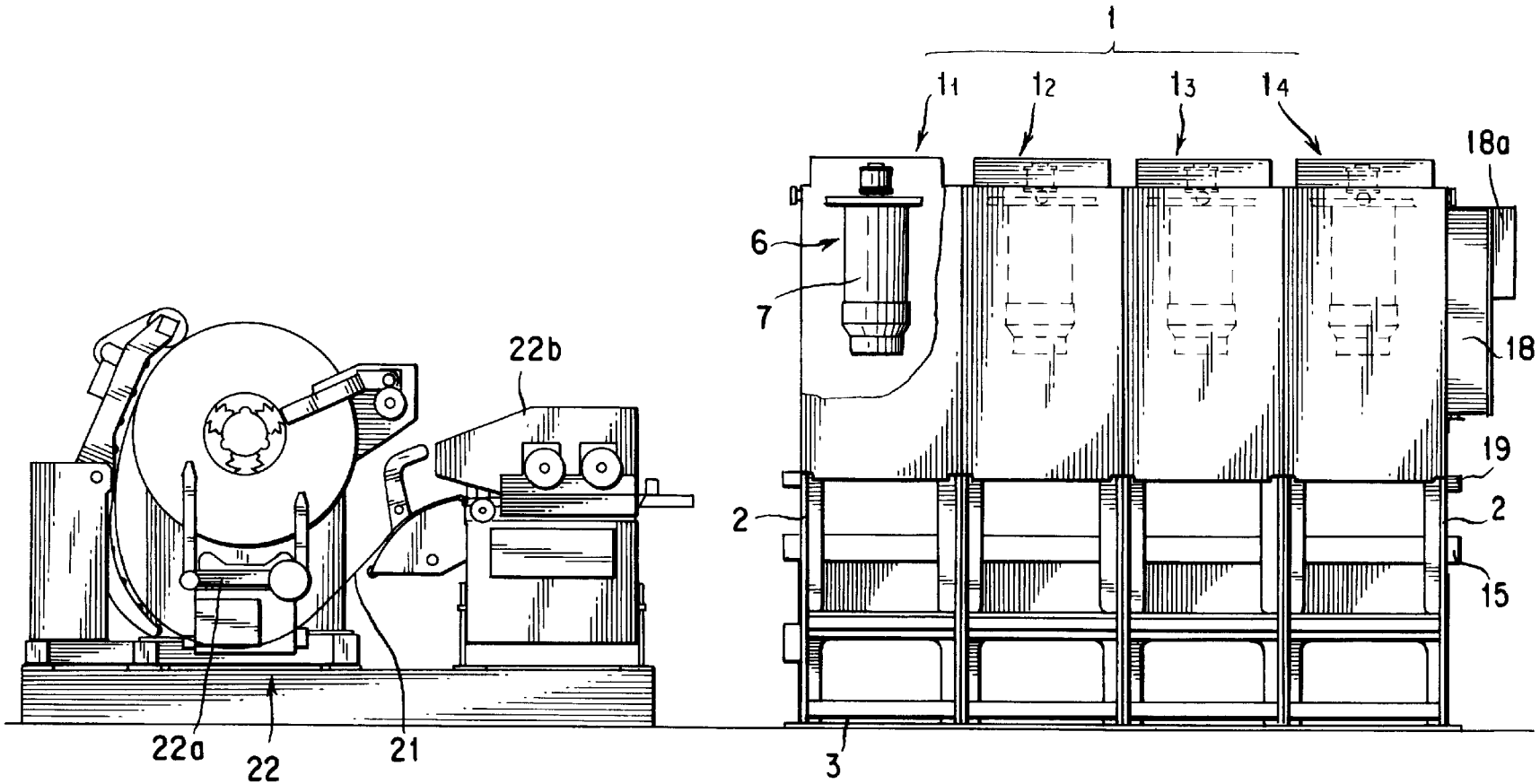
FIG. 13 is a front view that illustrates a modification of the machine according to the second form of embodiment of the present invention.
Figure 14:
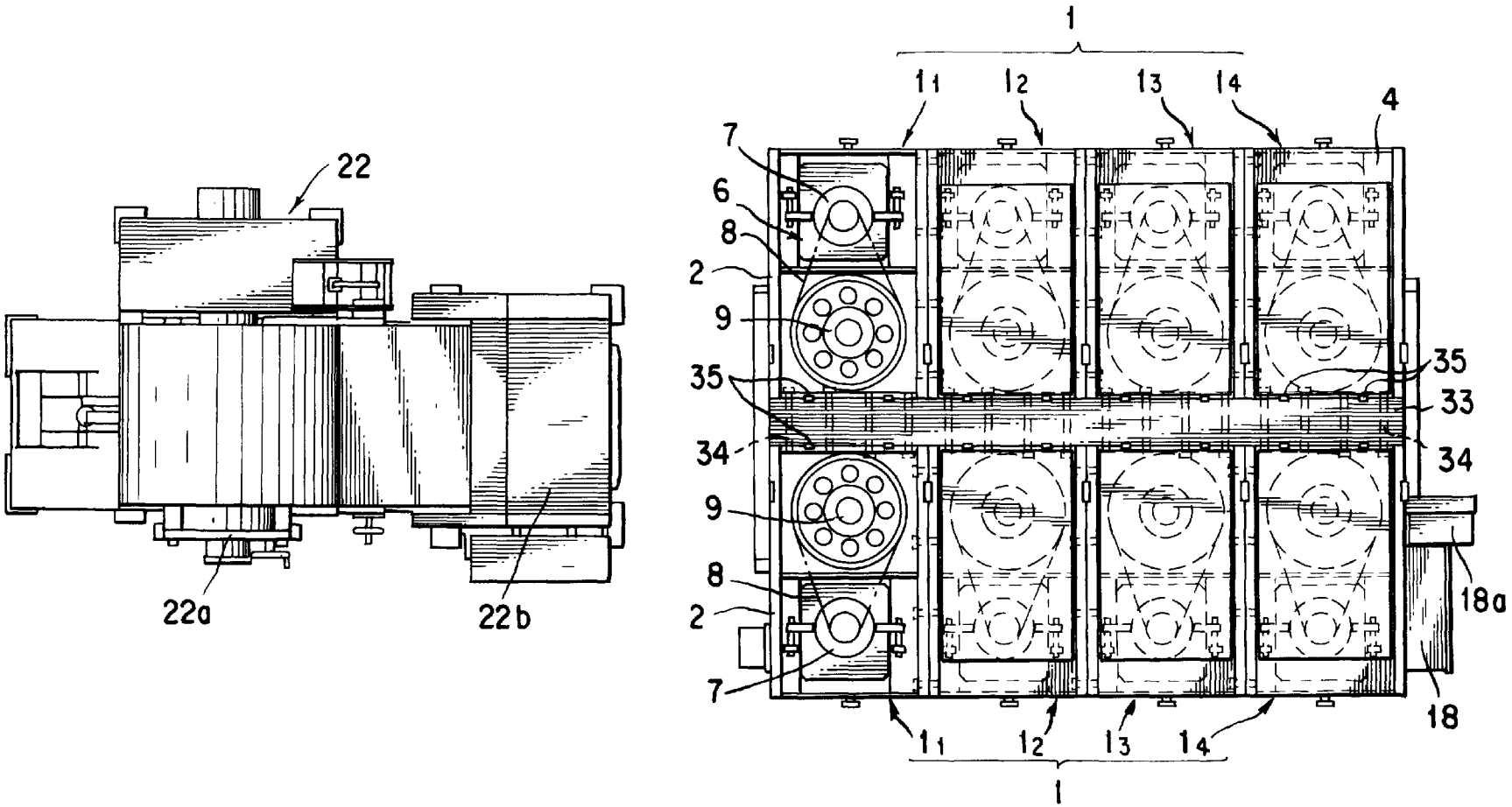
FIG. 14 is a top plan view of that modification of the press machine according to the second form of embodiment of the present invention.
Figure 15:
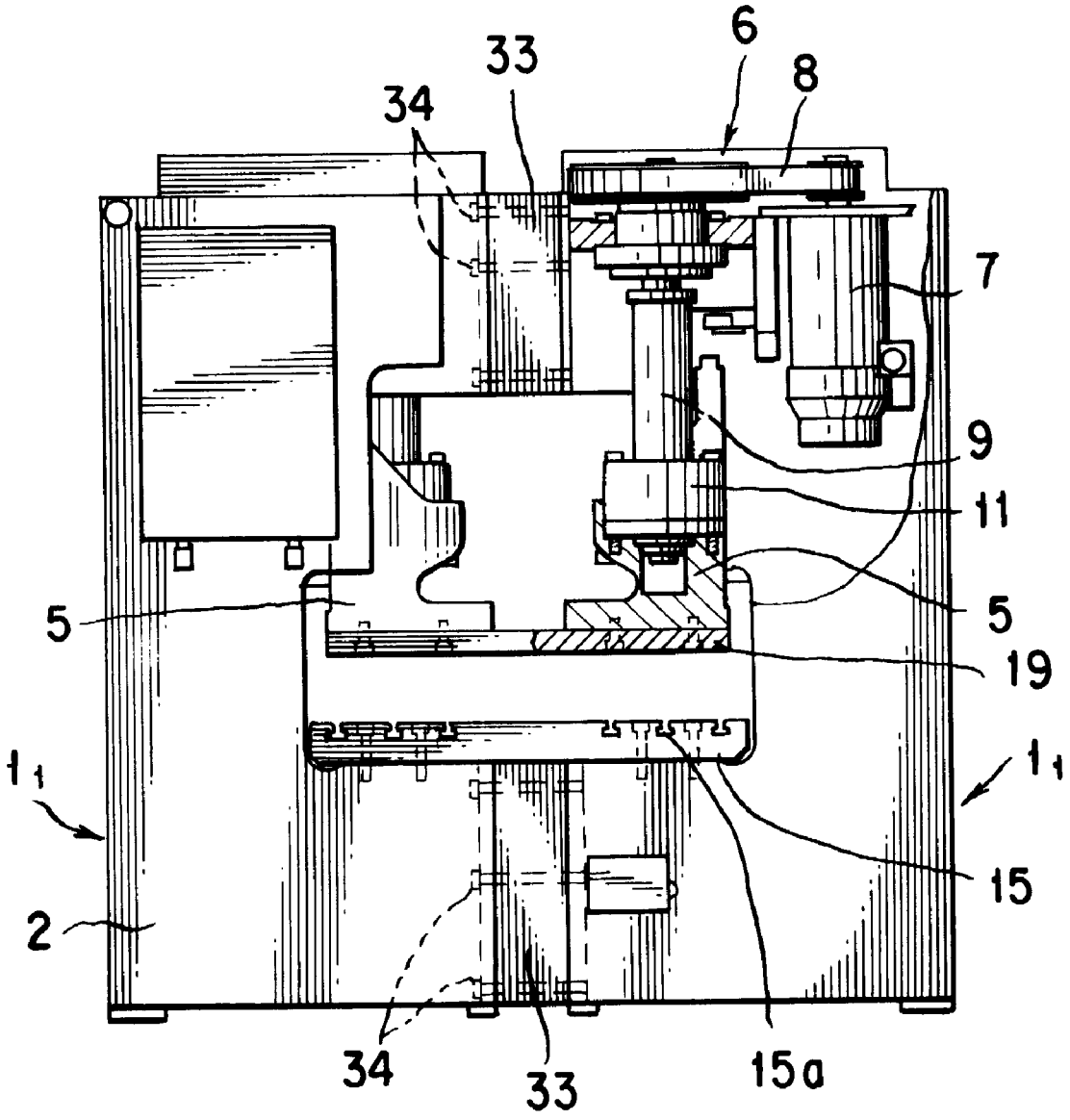
FIG. 15 is a side view of that modification of the press machine according to the second form of embodiment of the present invention in part fragmented and as seen from the right hand side in FIG. 13.

FIGS. 13 to 15 illustrate a pressing machine according to a modification of the second form of embodiment of the present invention shown in and previously described in connection with FIGS. 4 to 6, of which an explanation is now given.

While in the second form of embodiment two presses 1 and 1 each made up of a plurality of press units $\mathbf{1}_1$, $\mathbf{1}_2$, . . . interconnected are arranged each oriented in a direction of coil line with press units in the first press and those in the second press opposed face to face, in this modified form of embodiment provision is further made to have spacers 33 positioned by keys 35 and interposed between the opposed beds 3 and 3 and also between the opposed crowns 4 and 4 of the press units $\mathbf{1}_1$ and $\mathbf{1}_1$, $\mathbf{1}_2$ and $\mathbf{1}_2$, . . . in order to increase the width of the combined press, thereby making it possible to meet with a requirement for forming a work 21 that is wider than usual.

Thus, spacers 33 positioned using keys 35 are interposed between the mutually opposed beds 3 and 3 of all the press units $\mathbf{1}_1$ and $\mathbf{1}_1$, $\mathbf{1}_2$ and $\mathbf{1}_2$ . . . and those beds 3 and 3 are fastened together and interconnected using fastening means 34 such as bolts inserted so as to penetrate the spacers 33.

Similar spacers 33 positioned with keys 35 are also interposed between the mutually opposed crowns 4 and 4 of all the press units $\mathbf{1}_1$ and $\mathbf{1}_1$, $\mathbf{1}_2$ and $\mathbf{1}_2$ . . . and those crowns 4 and 4 are interconnected and fastened together using fastening means 34 such as bolts inserted so as to penetrate the spacers 33.

The pressing machine so constructed as described according to the modified second form of embodiment is operable as well to form the work 21 being progressively or sequentially along the coil line as in the pressing machine according to the unmodified second form of embodiment. With the combined press body increased in the total width or transverse length by a sum of the width of the spacers 33 interposed between the adjacent press units $\mathbf{1}_1$, $\mathbf{1}_2$, . . . in the direction transverse to the coil line, the modified pressing machine has an added capability of forming a wider or exceptionally wide work 21. Also, establishing two rows of working lines in front and in rear on the coil line permits works to undergo forming operations different in the step number or forming operations to yield products different in configuration.

In the modified forms of embodiment of the invention shown in and described in connection with FIGS. 10 to 12 and FIGS. 13 to 15, it should be noted that the spacers 30 and the spacers 33 are preferably made adjustable to vary the spacing between the adjacent or opposed press units. Making the spacers 30 so adjustable allows the longitudinal length of the press body 1 to be altered as desired, and making the spacers 33 so adjustable allows the width or transverse length of the combined press body 1 to be altered as desired.

It can also be seen that the third form of embodiment of the invention shown in and described in connection with FIGS. 7 to 9, namely in the construction in which the press units are arranged in a zigzag pattern may similarly be modified. Thus, the spacers 30 may be interposed between the C-form frames 2 and 2 of the adjacent press units $\mathbf{1}_1$ and $\mathbf{1}_2$, $\mathbf{1}_2$ and $\mathbf{1}_3$, . . . to increase or variably adjust the longitudinal length of the combined press body 1. Also, the spacers 33 may be interposed between the beds 3 and 3 and also between the crowns 4 and 4 of the press units to increase or variable adjust the width or transverse length of the combined press body 1. It is further possible to use both the spacers 30 and 33 to increase or variably adjust both longitudinal and transverse lengths of a combined press body in any of the arrangements described previously.

It should further be noted that if a draw forming process step is added in a usual forming process or between or among usual forming process steps, it is desirable to make the step of draw forming with the slide adapter plate 19 independent of the other forming step or steps so that any forming load in the draw forming step may not affect in any way the other forming operation or operations to ensure achieving high forming accuracy without any influence of draw forming. In this case, a slide adapter plate 19 is fastened to the lower surfaces of the slides 5 of some consecutive units of all the press units $\mathbf{1}_1$, $\mathbf{1}_2$, . . . and the slides 5 of the other press units may then have each individually a respective or have commonly a single slide adapter plate 19 fastened thereto. It is also possible to use bolsters 15 so subdivided fastened to the beds 3 corresponding to the slide adapter plates 19 mentioned above.

While the present invention has hereinbefore been set forth with respect to certain illustrative forms of embodiments thereof, it will readily be appreciated to be obvious to a person skilled in the art that many alternations thereof, omissions therefrom and additions thereto can be made without departing from the essences of scope of the present invention. Accordingly, it should be understood that the invention is not intended to be limited to the specific forms of embodiment thereof set forth below, but to include all possible forms of embodiment thereof that can be made within the scope with respect to the features specifically set forth in the appended claims and encompasses all the equivalents thereof.

What is claimed is:

1. A pressing machine for forming a work being progressively fed along a coil line, having a press assembly that comprises a plurality of modular press units connected from one to another in a direction in which the work is progressively fed, each of said press units including a C-form frame, a slide drive mechanism disposed in an upper part of said C-form frame and having in its drive source a servo motor means operable under NC, and a slide adapted to be driven by said slide drive mechanism to move in a given movement pattern, said press units having their respective slides as aforesaid, at least some of said slides having at least one slide adapter attached thereto, said at least one slide adapter extending across said at least some of the slides as a whole.

2. A pressing machine for forming a work being progressively fed along a coil line, having a press assembly that comprises a plurality of modular press units connected from one to another in a direction in which the work is progressively fed, each of said press units including a C-form frame, a slide drive mechanism disposed in an upper part of said C-form frame and having in its drive source a servo motor means operable under NC, and a slide adapted to be driven by said slide drive mechanism to move in a given movement pattern, said press units having their respective beds, said beds having at least one bolster mounted thereon, said at least one bolster extending across a length of said press assembly.

3. A pressing machine as set forth in claim 1 in which said press units are connected from one to another by fastening the respective C-form frames of the adjacent press units together by fastening means for said press units as a whole.

4. A pressing machine as set forth in claim 2 in which said press units are connected from one to another by fastening the respective C-form frames of the adjacent press units together by fastening means for said press units as a whole.

5. A pressing machine as set forth in any one of claims 1 to 4, the machine having a further second press assembly constructed as the same as the first assembly, said first and second press assemblies being arranged with their fronts opposed to each other across a coil line, the front of said first press assembly being defined by the respective front faces of the press units of said first press assembly and the front of said second press assembly being defined by the respective front faces of the press units of said second press assembly, each pair of the respective press units of said first and second press assemblies opposed to each other being interconnected by fastening their respective beds and crowns by fastening means for said press units as a whole.

6. A pressing machine as set forth in any one of claims 1 to 4, the machine having a further second press assembly constructed as the same as the first assembly, said first and second press assemblies being arranged with their fronts opposed zigzag to each other across a coil line, the front of said first press assembly being defined by the respective front faces of the press units of said first press assembly and the front of said second press assembly being defined by the respective front faces of the press units of said second press assembly, each pair of the respective press units of said first and second press assemblies opposed zigzag to each other being interconnected by fastening their respective beds and crowns by fastening means for said press units as a whole.

7. A pressing machine as set forth in any one of claims 1 to 4, further comprising spacer means adapted to be interposed between the respective C-form frames of the adjacent press units as a whole to permit an entire length of said press assembly to be established as desired.

8. A pressing machine as set forth in claim 5, further comprising spacer means adapted to be interposed between the respective C-form frames of the adjacent press units as a whole to permit an entire length of said press assembly to be established as desired.

9. A pressing machine as set forth in claim 6, further comprising spacer means adapted to be interposed between the respective C-form frames of the adjacent press units as a whole to permit an entire length of said press assembly to be established as desired.

10. A pressing machine as set forth in claim 5, further comprising spacer means adapted to be interposed between the respective beds and between the respective crowns of the press units opposed to each other as a whole to permit a width of said first and second press assemblies in their transverse direction.

11. A pressing machine as set forth in claim 6, further comprising spacer means adapted to be interposed between the respective beds and between the respective crowns of the press units opposed to each other as a whole to permit a width of said first and second press assembly in their transverse direction.

12. A press machine as set forth in claim 7 in which said spacer means is adjustable in width.

13. A press machine as set forth in claim 8 in which said spacer means is adjustable in width.

14. A press machine as set forth in claim 9 in which said spacer means is adjustable in width.

15. A press machine as set forth in claim 10 in which said spacer means is adjustable in width.

16. A press machine as set forth in claim 11 in which said spacer means is adjustable in width.

17. A pressing machine as set forth in claim 1 or claim 2 in which said press units includes press units for draw forming, and an adapter plate attached to the slides of the press units for draw forming is made independent of an adapter plate attached to the slides of the press units not for draw forming.

18. A pressing machine for forming a work being progressively fed along a coil line, having a first press assembly that comprises a plurality of modular press units connected from one to another in a direction in which the work is progressively fed, each of said press units including a C-form frame, a slide drive mechanism disposed in an upper part of said C-form frame and having in its drive source a servo motor means operable under NC, and a slide adapted to be driven by said slide drive mechanism to move in a given movement pattern, said press units having their respective slides as aforesaid, at least some of said slide adapter attached thereto, said at least one slide adapter extending across said at least some of the slides as a whole; and a further second press assembly constructed as the same as the first press assembly, said first and second press assemblies being arranged with their fronts opposed to each other across a coil line, the front of said first press assembly being defined by the respective front faces of the press units of said first press assembly and the front of said second press assembly being defined by the respective front faces of the press units of said second press assembly, each pair of the respective press units of said first and second press assemblies opposed to each other being interconnected by fastening their respective beds and crowns by fastening means for said press units as a whole.

19. A pressing machine for forming a work being progressively fed along a coil line, having a first press assembly that comprises a plurality of modular press units connected from one to another in a direction in which the work is progressively fed, each of said press units including a C-form frame, a slide drive mechanism disposed in an upper part of said C-form frame and having in its drive source a servo motor means operable under NC, and a slide adapted to be driven by said slide drive mechanism to move in a given movement pattern, said press units having their respective beds, said beds having at least one bolster mounted thereon, said at least one bolster extending across a length of said press assembly; and a further second press assembly constructed as the same as the first press assembly, said first and second press assemblies being arranged with their fronts opposed to each other across a coil line, the front of said first press assembly being defined by the respective front faces of the press units of said first press assembly and the front of said second press assembly being defined by the respective front faces of the press units of said second press assembly, each pair of the respective press units of said first and second press assemblies opposed to each other being interconnected by fastening their respective beds and crowns by fastening means for said press units as a whole.

* * * * *